US006971566B1

(12) United States Patent
Sartena

(10) Patent No.: US 6,971,566 B1
(45) Date of Patent: Dec. 6, 2005

(54) CARRY BAG

(75) Inventor: Stacey Eve Sartena, Smithtown, NY (US)

(73) Assignee: Hair Blast, Inc., Smithtown, NY (US)

( * ) Notice: Subject to any disclaimer, the term of this patent is extended or adjusted under 35 U.S.C. 154(b) by 0 days.

(21) Appl. No.: 10/819,507

(22) Filed: Apr. 6, 2004

(51) Int. Cl.[7] ..... A45C 15/00

(52) U.S. Cl. ..... 224/576; 224/647; 224/660; 2/122; 2/128

(58) Field of Search ..... 224/153, 578, 224/580, 577, 579, 647, 576, 660, 664; 2/247, 2/122, 128

(56) References Cited

U.S. PATENT DOCUMENTS

| | | | | |
|---|---|---|---|---|
| 2,134,425 | A * | 10/1938 | West | 2/125 |
| 2,959,789 | A | 11/1960 | Mills et al. | |
| 4,057,854 | A * | 11/1977 | Phelps, Sr. | 2/128 |
| 4,389,735 | A | 6/1983 | McLaughlin | |
| 4,502,154 | A * | 3/1985 | Itoi | 2/108 |
| 4,563,777 | A | 1/1986 | Park | |
| 4,862,520 | A | 9/1989 | Gazzola | |
| 4,932,574 | A | 6/1990 | Doshi | |
| 5,996,121 | A | 12/1999 | Harris | |
| 6,061,831 | A | 5/2000 | Rudolph et al. | |
| 6,141,800 | A | 11/2000 | Regan | |
| 6,237,152 | B1 | 5/2001 | Gootrad | |
| 6,336,221 | B1 | 1/2002 | Blauer et al. | |
| 2003/0102319 | A1 * | 6/2003 | Yamane | 220/739 |

* cited by examiner

*Primary Examiner*—Stephen K. Cronin
(74) *Attorney, Agent, or Firm*—Schweitzer Cornman Gross & Bondell LLP

(57) ABSTRACT

A multi-function carry bag in a form simulating a garment, such as a sweatshirt. Zippered pockets are provided in the ends of the sleeves, such that, when the sleeves are tied around a user's waist by an overhand knot, the pockets are conveniently available at the front. Clips are provided in the ends of the sleeves and at the waistband of the articles, enabling the sleeves to be connected to the waistband to form shoulder straps. The ends of the sleeves can likewise be connected together to form an over-the-shoulder strap. The body portion of the simulated comprises a large pocket accessible by a transverse zippered opening. The zippered opening is located above the lower edges of the sleeves, such that an upper panel portion of the article folds over the opening to conceal it during normal carry modes.

10 Claims, 3 Drawing Sheets

FIG. 3
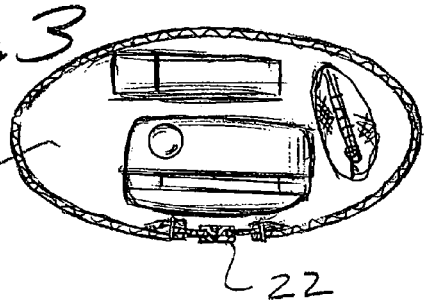
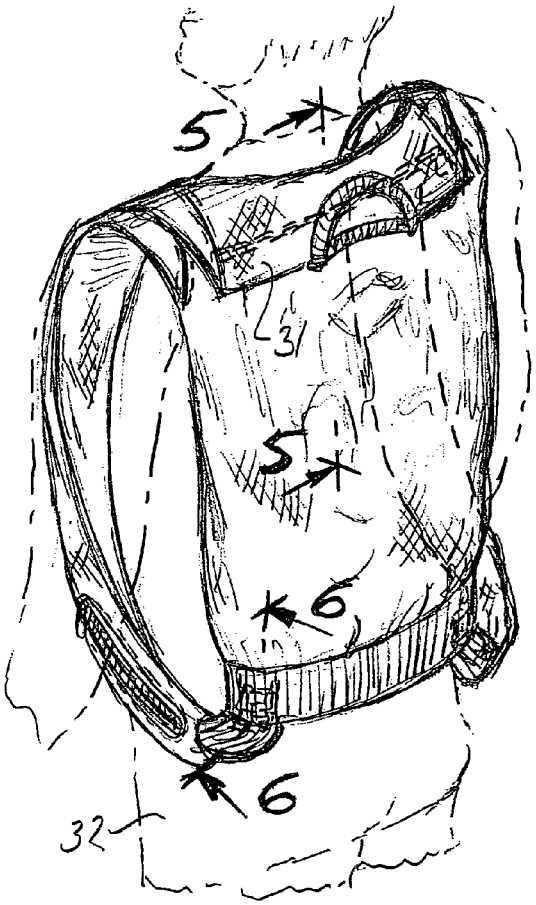
FIG. 4
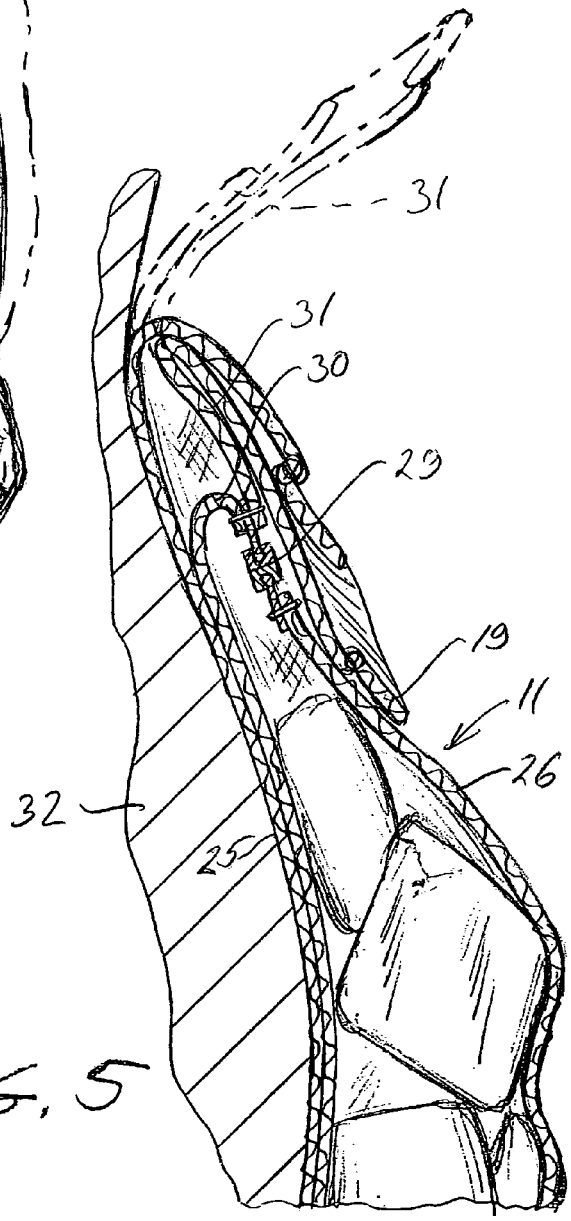
FIG. 5

CARRY BAG

BACKGROUND OF THE INVENTION

Many teenagers and young adults frequently use backpacks, over-the-shoulder bags and the like to carry routine "essentials" such as money, credit cards, cell phones, makeup, etc. The present invention is directed to an improved form of such carry bag, which is simple and inexpensive to manufacture, can be reconfigured in a variety of ways so as to function as a backpack, and over-the-shoulder bag and can be tied around the waist, for example.

SUMMARY OF THE INVENTION

The invention is directed to a carry bag which simulates the basic appearance of an ordinary garment, for example a sweatshirt, but which is designed and constructed to provide a multiplicity of pockets of various types, and with a plurality of variously located clips (preferably concealed) which enable the unit to be quickly reconfigured from one type of a carry bag to another, depending upon the momentary needs or desires of the user.

In a particularly preferred and advantageous form of the invention, the carry bag is constructed to simulate an ordinary sweatshirt, although it is not intended that it could or should be worn as such. Pursuant to the invention, the end extremities of the sleeves are formed with pockets, provided with zipper or other closure means, which pockets extend from a point near the ends of the sleeves for several inches (for example, six to ten) toward the elbow areas of the sleeves. In this form of the invention, it is contemplated that the carry bag will be employed by the user by being tied around the user's waist, with for example a single overhand knot of the sleeves across the waist front of the user. The ends of the sleeves in such a case hang downward providing easy availability of the zippered pockets provided in the end portions of the sleeves. The carry bag used in this manner has all the general appearances of a normal sweatshirt as carried in a normal way when not being worn, i.e., by being tied around the user's waist with the body of the simulated sweatshirt behind the wearer.

In accordance with another feature of the invention, the sweatshirt-like carry bag is provided with a large pocket within the main body portion of the simulated sweatshirt, preferably with a large, transverse zippered opening in an upper portion thereof, in the region where the sleeves join the body portion of the sweatshirt-like article. The design of the upper structure of the article is such that, when the carry bag is worn in any of the various manners intended, the upper or "shoulder" portions of the article form a flap which falls down over the top of the zippered opening in the bag, serving to conceal that opening while providing easy access to the user.

In accordance with another aspect of the invention, connecting clips are provided at the ends of the sleeves and also at the waistband area at the front of the simulated garment. Accordingly, by joining the connecting clips of the sleeves with those at the waistband area of the sweatshirt-configured carry bag, the unit is converted into a backpack. Depending on the desires of the user, the sleeves may be crossed or parallel, as a function of the manner in which the sleeves are attached to the respective waistband clips. Preferentially, the clips are concealed within the sleeve cuffs and waistband of the simulated clothing article.

As a further aspect of the invention, the connector clips of the two sleeves may be joined to each other to form a shoulder strap comprised of the two sleeves. Thus, a single simulated sweatshirt carry bag can be arranged in a variety of ways to suit the user's convenience and style considerations.

For a better understanding of the above and other features and advantages of the invention, reference should be made to the following detailed description of a preferred embodiment of the invention, and to the accompanying drawings.

DESCRIPTION OF THE DRAWINGS

FIG. 3 is a cross sectional view as taken generally on line 3—3 of FIG. 2.

FIG. 4 is a perspective view showing the carry bag configured as a backpack, with the sleeves connected as parallel straps.

FIG. 5 is an enlarged fragmentary cross sectional view as taken generally on line 5—5 of FIG. 3.

DESCRIPTION OF PREFERRED EMBODIMENTS

Figure 1:
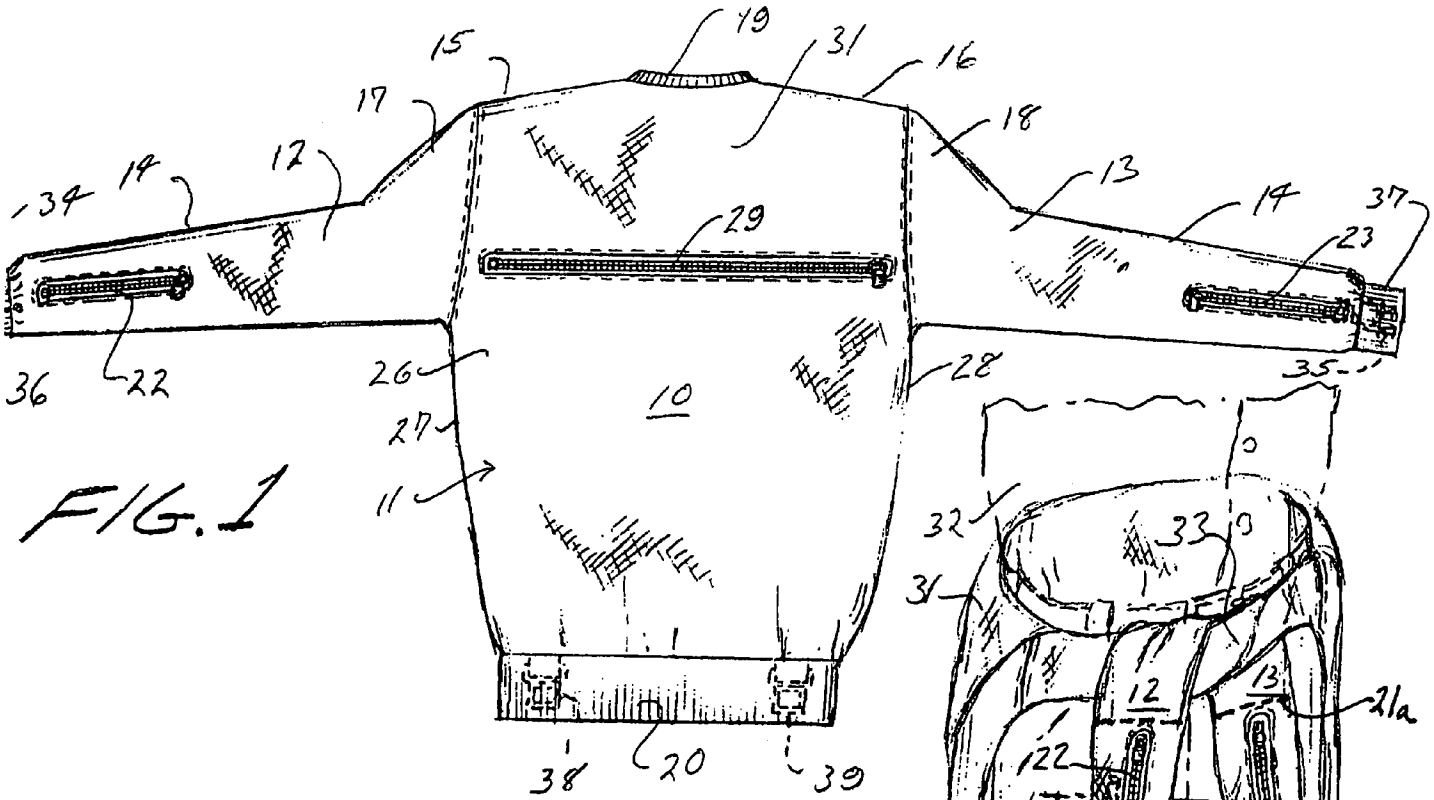
FIG. 1 is a plan view of a simulated sweatshirt carry bag according to the invention.

Referring now to the drawing, the reference numeral 10 designates generally a carry bag configured in the form of a simulated sweatshirt, for example, and comprised of a body portion 11 and sleeves 12, 13. As compared to a conventional sweatshirt, for example, the sleeves 12, 13 preferably are considerably narrower than the conventional sleeves, and the main upper edge lines 14 of the sleeves intersect the body portion 11 well below the upper limits of the shoulder portions 15, 16. Connecting gusset portions 17, 18 preferably are provided to join the upper lines 14 of the sleeves to the top portions of the shoulders 15, 16, as shown in FIG. 1.

As shown in FIG. 1, the body portion 11 of the simulated sweatshirt carry bag typically is provided with a conventional-appearing neck portion 19 and waistband portion 20. Indeed, the article of the invention can be constructed utilizing conventional sweatshirt components for its outer layers, with the outer portions of the sleeves 12, 13 being narrowed as compared to conventional sleeves, and widened out at their inner ends by the gusset sections 17, 18 to join with otherwise normally configured shoulder openings formed in the body 11.

Pursuant to one aspect of the invention, the outer end portions of the sleeves 12, 13 are provided with pockets 21 (FIG. 3) with access openings 22, 23 provided with suitable closure means preferably of a continuous nature, such as zippers, hook and loop (e.g., Velcro) fasteners or the like. Internally, the sleeves 12, 13 are closed above and below the extremities of the access openings 22, 23 by fabric panels 21*a* (FIG. 2) extending transversely across the sleeves above and below the access openings. Alternatively, the sleeves 12, 13, which otherwise are hollow, could be stitched closed at 21*a*, above and below the access openings. As shown in FIG. 3, the sleeve pockets 21 may suitably contain such items as a cell phone, lipstick, change purse, etc.

In the preferred form of the invention, the body portion 11 of the simulated sweatshirt is comprised of front and back panels 25, 26 joined at the opposite side edges 27, 28 to form a tubular enclosure, which may be open at the neck portion 19 and waist portion 20. An access opening 29 extends laterally across most of the width of the back panel 26 and defines the upper end of a large pocket. Suitable continuous closure means, such as a zipper, Velcro, etc. are provided for closing the opening 29. Internally, a fabric section 30 (FIG. 5) is secured to the back panel 26, above the access opening 29, above the waistband 20, and laterally adjacent the opposite side edges 27, 28. The fabric section 30, in conjunction with the back panel 26, defines a large pocket within the simulated sweatshirt body, which is accessible through the opening 29.

As shown in FIG. 1, the access opening 29 advantageously is spaced several inches below the neck opening 19, and preferably slightly below the level at which the main upper edge lines 14 of the sleeves intersect with the side edges of the body 11, thus defining a significant panel area 31 in the body of the simulated sweatshirt above the access opening 29. In addition, as also shown in FIG. 1, the access opening 29 is positioned somewhat above the level at which the lower edges of the sleeves 12, 13 intersect with the side edges of the body 11.

Figure 2:
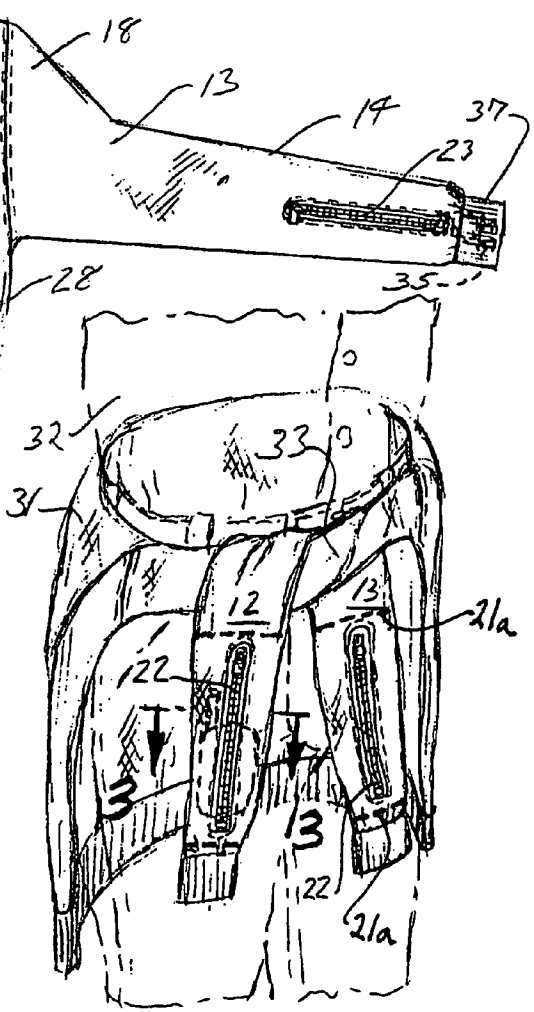
FIG. 2 is a perspective view showing the carry bag of FIG. 1 used with the sleeves tied around the user's waist.
Figure 6:
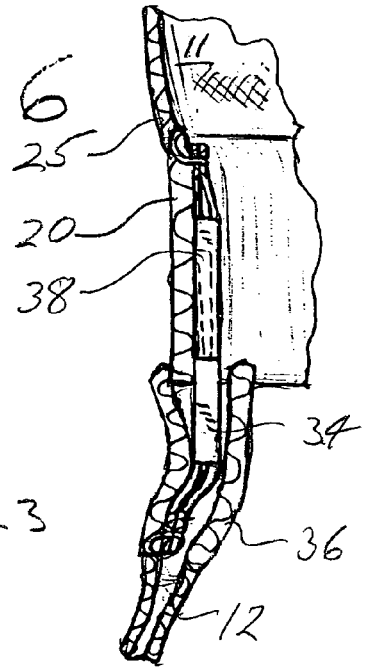
FIG. 6 is an enlarged fragmentary cross sectional view as taken generally on line 6—6 of FIG. 4.

The simulated sweatshirt carry bag, as thus far defined, is utilized by placing the body 11 behind the user 32 (FIG. 2) and tying the two sleeves 12, 13 around the user's waist, typically by a simple overhand knot at the front of the user, as reflected in FIG. 2. This is a common and natural way that teenagers and young adults commonly carry a conventional sweater or sweatshirt, for example, when not being worn in the normally intended way, over the upper torso of the user. As is evident in FIG. 2, the outer end portions of the sleeves 12, 13, including the portions thereof containing the pockets 21, hang downward from the area of the overhand knot 33. The zippered access openings 22, 23 are readily accessible to the user providing a convenient means of carrying small articles.

With the simulated sweatshirt carry bag used in the configuration of FIG. 2, the panel 31 above the zippered access opening 29 naturally folds downward over the face of the zipper, such that the opening 29 typically is concealed from view.

Pursuant to another aspect of the invention, conventional plastic snap-together clips 34, 35 are secured within elastic bands 36, 37 at the ends of the respective sleeves 12, 13. Likewise, similar clips 38, 39, but of the opposite "polarity" are secured within the waistband 20, preferably adjacent side edges of the front panel 25. The clips 35, 36 and 38, 39 may be of any conventional, well known type which can be connected together by a telescopic, snap-together action and remain joined until intentionally released.

In the configuration of the carry bag shown in FIG. 4, the sleeve connector 34 is joined with the waistband connector 38 at the same side, and the sleeve connector 35 is also joined with the waistband connector 39 at the same side to form a backpack, with "parallel" shoulder straps. It will be understood, however, that the sleeves 12, 13 may be crossed by joining the sleeve connector 34 with the waistband connector 39 at the opposite side and similarly joining the sleeve connector 35 with the waistband connector 38.

Figure 7:
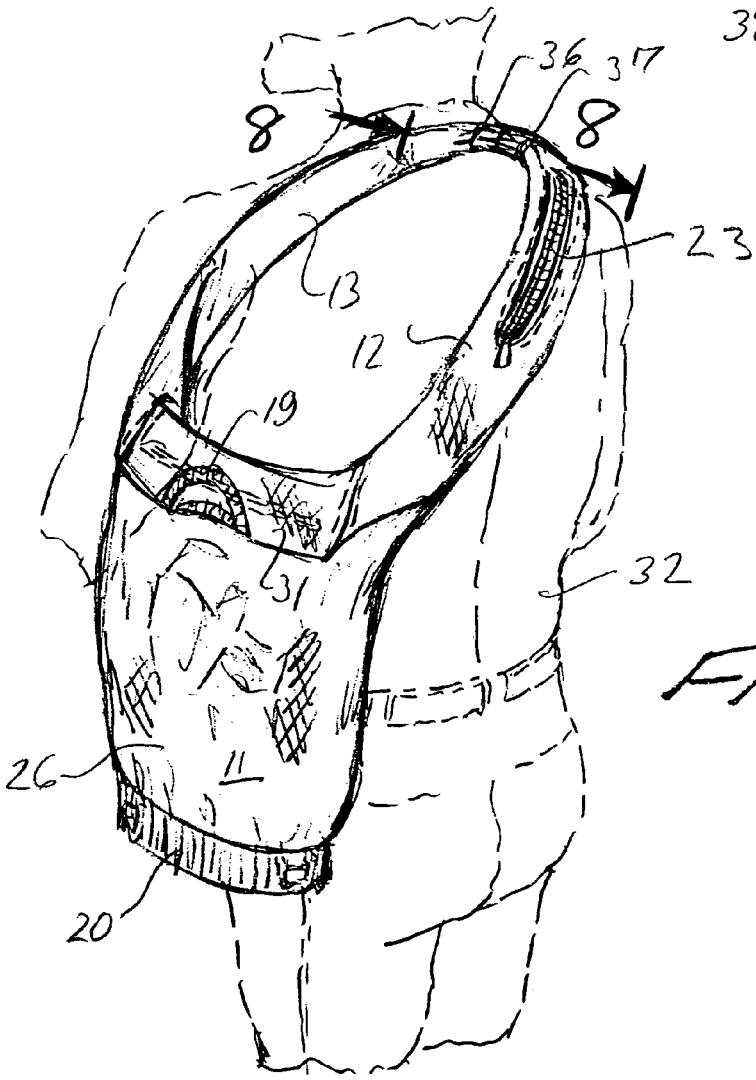
FIG. 7 is a perspective view showing the carry bag worn with the sleeves connected to each other to form an over-the-shoulder strap.
Figure 8:
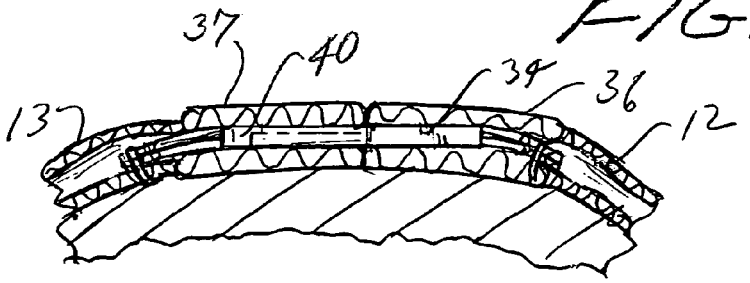
FIG. 8 is a cross sectional view as taken generally on line 8—8 of FIG. 7.

In the configuration of the new carry bag shown in FIGS. 7 and 8, connectors in the respective sleeves 12, 13 may be joined to each other so that the sleeves form a shoulder strap. In the form of the invention previously described, the sleeves 12, 13 can be connected in a backpack configuration in either a parallel or crossed arrangement. This capability requires the connectors in both sleeves to be of one "polarity" and the connector clips located in the waistband to be of the opposite polarity. To accommodate the shoulder strap configuration of FIG. 7, the connector clips of the two sleeves must be of opposite polarities. Accordingly, if each sleeve 12, 13 has one clip of different polarity from the other, the backpack configuration must be limited to either parallel configuration or cross configuration, but cannot accommodate both. Alternatively, one of the sleeves 12 or 13 may be provided with two clips of opposite polarity, including a second clip 40 (FIG. 8) of opposite polarity from the clip on the opposite sleeve, so that all of the illustrated configurations are enabled.

The invention provides a uniquely advantageous form of carry bag, constructed as a simulated sweatshirt, which can be conveniently tied around the waist, configured as a backpack, or arranged with its sleeves connected to form an over-the-shoulder bag. The user has the convenient option of configuring the carry bag in any of the described optional arrangements at any time, depending upon his or her desires of the moment, with a minimum of effort.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A carry bag in the form of a simulated full size garment, which comprises (a) a body portion and opposite side simulated sleeve portions, (b) outer end portions of both of said simulated sleeve portions being closed off at spaced apart locations to form internal sleeve pockets, (c) said outer end portions having sleeve pocket openings therein providing access to said internal sleeve pockets, and (d) closure means for said sleeve pocket openings, (e) said carry bag being adapted for carrying by a user by tying said simulated sleeve portions in a knot about the waist of said user, with said sleeves being of a length to enable outer end portions thereof with said sleeve pockets to hang freely below said knot for ready access to said closure means and said sleeve pocket openings.

2. A carry bag according to claim 1, wherein (a) said outer end portions of said simulated sleeve portions are closed off by fabric panels extending transversely across the sleeves above and below said sleeve pocket openings.

3. A carry bag according to claim 1, wherein (a) said outer end portions of said simulated sleeve portions are closed off by being stitched closed above and below said sleeve pocket openings.

4. A carry bag in the form of a simulated full sized garment comprising, (a) a body portion having a neck portion, and opposite side edge portions, (b) sleeves joined to the opposite side edge portions of said body portion, (c) said sleeves having upper and lower principal edges when said simulated garment is configured in a flat form, (c) said body portion including front and back panels and having an internal body pocket, (d) a body pocket access opening extending laterally across said back panel adjacent a top of said internal body pocket and including closure means, (e) said body pocket access opening being positioned at a level which is below said neck portion and above the intersection of the lower principal edge lines of said sleeves with the side edges of said body portion, (f) a region of said body portion above said access opening defining a foldable panel portion adapted, when said sleeve portions are tied about the user's waist, to fold-over and conceal said access opening.

5. A carry bag according to claim 4, wherein (a) first connector clips are attached within end extremities of said sleeves portions, (b) second connector clips are attached to inside lower edge portions of the front panel of said body portion, and (c) said first connector clips are releasably connectible with said second connector clips to form said sleeve portions into shoulder straps, whereby said carry bag functions as a back pack.

6. A carry bag according to claim 4, wherein (a) said body pocket access opening is positioned at a level which is below the intersection of the upper principal edge lines of said sleeves and the side edges of said body portion.

7. A carry bag according to claim 4, wherein (a) an upper portion of said body comprises said neck portion and laterally extending shoulder portions on opposite sides of said neck portion, (b) upper principal edge lines of said sleeves intersect with side edges of said body at a location below said shoulder portions, and (b) gusset sections connect said sleeves with side edges of said body portion between said upper principal edge lines and said shoulder portions.

8. A carry bag according to claim 4, wherein (a) said sleeves are simulated sleeves, (b) outer end portions of said sleeves are closed off at spaced apart locations to form internal sleeve pockets, (b) said outer end portions have sleeve pocket openings therein providing access to said internal sleeve pockets, and (c) closure means are provided for said sleeve pocket openings, and (d) said carry bag is adapted for carrying by a user by tying said simulated sleeves in a knot about the waist of said user, with said sleeve being of a length to enable outer end portions thereof to hang freely below said knot for ready access to said closure means and said sleeve pocket openings.

9. A carry bag according to claim 4, wherein (a) said body pocket closure means comprises a continuous closure extending along substantially an entire length of said body pocket access opening.

10. A carry bag according to claim 9, wherein (a) said body pocket closure comprises a zipper.

* * * * *